US008664630B1

(12) United States Patent
Metzger et al.

(10) Patent No.: US 8,664,630 B1
(45) Date of Patent: Mar. 4, 2014

(54) THERMAL NEUTRON SHIELD AND METHOD OF MANUFACTURE

(75) Inventors: Bert Clayton Metzger, Seaford, VA (US); Paul Daniel Brindza, Yorktown, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 228 days.

(21) Appl. No.: 13/068,597

(22) Filed: May 16, 2011

Related U.S. Application Data

(63) Continuation-in-part of application No. 13/065,437, filed on Mar. 22, 2011.

(51) Int. Cl.
*G21C 11/08* (2006.01)

(52) U.S. Cl.
USPC ..... 250/518.1; 250/505.1; 250/515.1; 250/517.1

(58) Field of Classification Search
None
See application file for complete search history.

(56) References Cited

U.S. PATENT DOCUMENTS

| | | | | | |
|---|---|---|---|---|---|
| 2,505,061 | A | * | 4/1950 | Oliver | 330/91 |
| 2,505,151 | A | * | 4/1950 | Schweitz | 242/395 |
| 2,505,181 | A | * | 4/1950 | Gruss | 24/495 |
| 3,361,684 | A | * | 1/1968 | Chvatal | 252/478 |
| 4,090,083 | A | * | 5/1978 | Wyvill | 250/390.01 |
| 4,123,392 | A | * | 10/1978 | Hall et al. | 252/478 |
| 4,134,937 | A | * | 1/1979 | Cass et al. | 523/136 |
| 4,156,147 | A | * | 5/1979 | Naum et al. | 250/515.1 |
| 4,198,322 | A | * | 4/1980 | Storm | 252/478 |
| 4,213,883 | A | * | 7/1980 | Owens | 252/478 |
| 4,218,622 | A | * | 8/1980 | McMurtry et al. | 250/519.1 |
| 4,225,467 | A | * | 9/1980 | McMurtry et al. | 252/478 |
| 4,287,145 | A | * | 9/1981 | McMurtry et al. | 264/109 |
| 4,293,598 | A | * | 10/1981 | Hortman et al. | 427/203 |
| 4,684,480 | A | * | 8/1987 | Lipp et al. | 252/478 |
| 4,744,922 | A | * | 5/1988 | Blakely et al. | 252/478 |
| 4,760,252 | A | * | 7/1988 | Albats et al. | 250/390.07 |
| 5,156,804 | A | * | 10/1992 | Halverson et al. | 376/419 |
| 5,262,463 | A | * | 11/1993 | Berzen | 524/404 |
| 5,786,611 | A | * | 7/1998 | Quapp et al. | 250/515.1 |
| 5,965,829 | A | * | 10/1999 | Haynes et al. | 75/238 |
| 6,166,390 | A | * | 12/2000 | Quapp et al. | 250/506.1 |
| 6,521,703 | B2 | * | 2/2003 | Zarnoch et al. | 525/17 |
| 6,605,817 | B1 | * | 8/2003 | Nihei et al. | 250/518.1 |
| 6,630,683 | B2 | * | 10/2003 | Vanvor | 250/518.1 |
| 6,797,972 | B2 | * | 9/2004 | Kamoshida et al. | 250/507.1 |
| 7,160,486 | B2 | * | 1/2007 | Valiere | 252/478 |
| 7,327,821 | B2 | * | 2/2008 | Ishihara et al. | 376/272 |
| 7,399,431 | B2 | * | 7/2008 | Abadie et al. | 252/478 |
| 7,524,438 | B2 | * | 4/2009 | Malalel et al. | 252/478 |
| 7,811,475 | B2 | * | 10/2010 | Hayashi | 252/478 |
| 2002/0134951 | A1 | * | 9/2002 | Vanvor | 250/515.1 |
| 2003/0102445 | A1 | * | 6/2003 | Kamoshida et al. | 250/507.1 |
| 2004/0127599 | A1 | * | 7/2004 | Abadie et al. | 523/136 |
| 2005/0012054 | A1 | * | 1/2005 | Valiere | 250/505.1 |
| 2005/0157833 | A1 | * | 7/2005 | Ishihara et al. | 376/272 |
| 2008/0035891 | A1 | * | 2/2008 | Hayashi | 252/478 |
| 2010/0041808 | A1 | * | 2/2010 | Canfer et al. | 524/404 |
| 2011/0175263 | A1 | * | 7/2011 | Pujari et al. | 264/604 |

FOREIGN PATENT DOCUMENTS

| | | | | |
|---|---|---|---|---|
| JP | 02162295 | A | * | 6/1990 |

* cited by examiner

*Primary Examiner* — Andrew Smyth

(57) ABSTRACT

A thermal neutron shield comprising boron shielding panels with a high percentage of the element Boron. The panel is least 46% Boron by weight which maximizes the effectiveness of the shielding against thermal neutrons. The accompanying method discloses the manufacture of boron shielding panels which includes enriching the pre-cursor mixture with varying grit sizes of Boron Carbide.

4 Claims, 1 Drawing Sheet

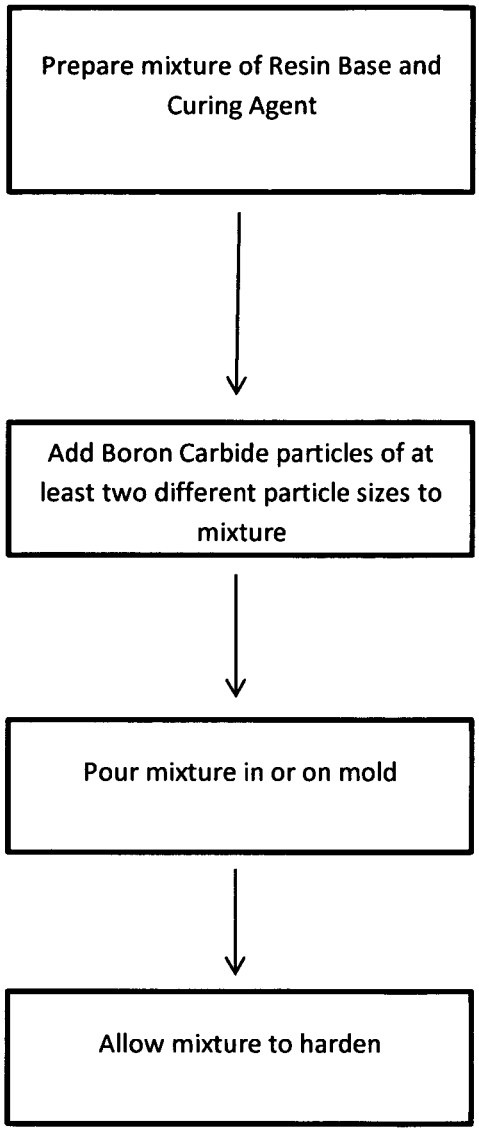
Prepare mixture of Resin Base and Curing Agent
Add Boron Carbide particles of at least two different particle sizes to mixture
Pour mixture in or on mold
Allow mixture to harden

THERMAL NEUTRON SHIELD AND METHOD OF MANUFACTURE

This application is a continuation-in-part application from U.S. application Ser. No. 13/065,437 filed on Mar. 22, 2011 and claims priority from the foregoing application.

The United States of America may have certain rights to this invention under Management and Operating Contract No. DE-AC05-84ER 40150 from the Department of Energy.

FIELD OF THE INVENTION

The present invention relates to a panel for shielding thermal neutrons through the use of lightweight panels which incorporate a high percentage of the element Boron, and a method of making such a panel.

BACKGROUND OF THE INVENTION

Neutron radiation may be generated as a result of a variety of nuclear reactions or interactions. More specifically, devices such as particle accelerators and nuclear reactors may emit neutrons during operation. A portion of such neutron emissions may subsequently classify as thermal neutrons. Neutrons, including thermal neutrons, have a deleterious effect on both living matter and inanimate objects. Thermal neutrons may also participate in neutron activation, thereby inducing radioactivity in environmental materials, equipment, and structures.

It is of vital importance, therefore, to provide adequate shielding from any sources of neutron radiation. Various methods and devices are known to be capable of providing shielding from such radiation.

It is known that elemental Boron has beneficial properties when used as a component of shielding devices. The highest density Boron possible is desirable in order to maximize the effectiveness of the shielding. As a result, shielding arrangements such as dry-packed Boron Carbide in metal boxes, Boron-loaded polyethylene plastic sheets, and Boron-loaded drywall have been disclosed in the art. Unfortunately, none of the foregoing technologies or systems are able to achieve a high Boron density. Further, all such technologies are traditionally quite expensive to deploy. It is therefore preferable to have a cost-effective method of shielding that is able to take advantage of the characteristics of the element Boron so as to provide an adequate amount of shielding from thermal neutrons.

It is further desirable that such shielding should be lightweight and easily transported and installed. Accordingly, a need exists for boron-enriched panels which can be easily deployed to shield discrete rooms or locations.

OBJECT OF THE INVENTION

It is an object of the invention to provide a boron shielding panel and a method of making same which can be used as an effective but low-cost thermal neutron shield, and, further, possess sufficient rigidity, be easily maintainable, cleanable, and customizable.

SUMMARY OF THE INVENTION

A boron shielding panel which can be used as a thermal neutron shield. Boron, in the form of Boron Carbide of varying grit sizes, is added during panel manufacture.

In a preferred embodiment of the invention, the total Boron Carbide content of the mixture includes 50% coarse Boron Carbide particles and 50% fine Boron Carbide particles. The panel provides an efficient and inexpensive shield for thermal neutrons that is easily deployed and customizable for the required application.

BRIEF DESCRIPTION OF THE DRAWINGS

FIG. 1 is a flow chart showing the method of manufacture of the neutron shielding panel.

DETAILED DESCRIPTION

It is recognized in the art that the element Boron may be used in various fashions in order to provide radiation shielding. Boron is particularly suitable for neutron shielding applications as it has one of the highest neutron absorption cross-sections of all elements. The ability of Boron to effectively capture neutrons makes it ideal for applications involving thermal neutron shielding. A cost-effective method of shielding thermal neutrons can therefore be realized by making composite panels with a high percentage of Boron.

It is observed that the compound Boron Carbide ($B_4C$) contains as much as seventy-six percent (76%) Boron by weight and is the highest Boron-containing compound known. Boron Carbide is commonly used as an abrasive, in anti-ballistic materials, and in industrial applications. It is a hard, granular material which can be obtained in various grit or particle sizes.

In the preferred embodiment of the invention disclosed herein, the shielding panels are composed of a resin base and Boron Carbide particles. Specifically, the three principal components of the panel are as follows: (1) resin base or glue, (2) hardener, and (3) Boron Carbide. In the preferred embodiment, the glue consists of an unsaturated polyester resin in a styrene monomer ($C_6H_5CH{=}CH_2$), such as the commercially available product POLYLITE™ 32132-18. It will be noted that the glue can consist of any resin or resin mixture with similar properties. A hardener (cure initiator), such as the commercially available NOROX™ MEKP-9 in liquid form, would be used in the mixture. Nuclear-grade Boron Carbide of two particle sizes, coarse and fine, are further included in the mixture.

In order to prepare the panels, the glue and hardener are mixed together by weight. The Boron Carbide powder is then progressively introduced into the mixture. The final mixture consists of essentially sixty percent (60%) Boron Carbide and forty percent (40%) glue or resin mixture. The mixture is then poured onto a mold and permitted to dry, and, commensurately, harden. If necessary, the mixture may be agitated after pouring so as to facilitate the removal of air from the mix. It will be noted that three-dimensional molds can be used to prepare various customized three-dimensional forms and shapes for these panels.

As an example, a mixture could be as follows: (1) 37 pounds of Boron Carbide, (2) 24 pounds of resin, and (3) 106 cubic centimeters of catalyst, for a total wet mixture weight of 61 pounds. As a further example, a panel of 6"×6"×⅜" with a total weight of 13.4 ounces would consist of sixty percent (60%) Boron Carbide with a weight of 8.04 ounces and forty percent (40%) resin with a weight of 5.36 ounces.

The use of varying Boron Carbide grit sizes is critical in order to achieve a high density of Boron Carbide content in the final panel product. In a preferred embodiment of the invention, two particle sizes, coarse and fine, are used. The fine grade consists of particles of an average size of 16.4 microns and a maximum size of 50 microns. The coarse grade consists of particles with an average size of 105 microns and a maximum size of 140 microns. The percentage of any one particular grade can vary between 30% to 70%, with the second grade being of a commensurate percentage. In the preferred embodiment, the total Boron Carbide content of the mixture includes 50% coarse Boron Carbide particles and 50% fine Boron Carbide particles. The final panel would be at least forty-six percent (46%) Boron by weight.

The panels possess sufficient strength and rigidity to be utilized and mounted in a variety of shielding applications. The panels possess a hard surface but can be drilled, sawed, glued, or bolted with appropriate tools. The panels can also be prepared with a variety of surface colors so as to insure that they are aesthetically pleasing. Further, the panels are easily cleanable and maintainable.

Potential industrial applications would include new nuclear reactor power plants, nuclear detection or fabrication facilities, buildings or rooms containing nuclear medical devices, particle beam facilities, high-density shielding for nuclear propulsion systems, and any other application where the reduction of thermal nuclear radiation must be accomplished.

While the invention has been described in reference to certain preferred embodiments, it will be readily apparent to one of ordinary skill in the art that certain modifications or variations may be made to the composition and method without departing from the scope of invention described in the foregoing specification.

What is claimed is:

1. A thermal neutron shielding material comprising:

a panel containing a resin mixture, said resin mixture including the following constituents: styrene and a polymerization catalyst; and Boron Carbide, said Boron Carbide being nuclear grade Boron Carbide in particle form and comprises 50% of a first coarse particle size and 50% of a second fine particle size, wherein said panel is at least 46% Boron by weight.

2. The thermal neutron shielding material of claim 1 wherein said shielding is in a customizable panel form.

3. A neutron shielding structure comprising:

one or more wall elements; and at least one neutron shielding panel element comprised of styrene and Boron Carbide being secured to said one or more wall elements, said Boron Carbide being nuclear grade Boron Carbide in particle form and comprises essentially 50% of a first coarse particle size and essentially 50% of a second fine particle size, wherein said neutron shielding panel element is at least 46% Boron by weight.

4. A method of constructing a neutron shielding material comprising:

preparing a mixture including an unsaturated polyester resin in styrene, a curing agent, and nuclear grade Boron Carbide in particle form that comprises essentially 50% of a first coarse particle size and essentially 50% of a second fine particle size;

pouring said mixture; and curing said mixture so as to obtain a finished panel element, wherein said finished panel element is at least 46% Boron by weight.

* * * * *